United States Patent [19]

Burnham

[11] Patent Number: 4,829,158

[45] Date of Patent: May 9, 1989

[54] PORTABLE ELECTRIC OVEN UTILIZING RECIRCULATING HIGH SPEED AIR FOR COOKING

[75] Inventor: Lowell C. Burnham, Lisle, Ill.

[73] Assignee: Sunbeam Corporation, Downers Grove, Ill.

[21] Appl. No.: 141,871

[22] Filed: Jan. 6, 1988

[51] Int. Cl.[4] ..... F24C 7/00; F24H 3/06

[52] U.S. Cl. ..... 219/400; 126/21 A

[58] Field of Search ..... 219/400, 540, 388, 365, 219/370; 126/21 A, 21 R; 99/444, 445, 473, 474, 476

[56] References Cited

U.S. PATENT DOCUMENTS

| | | | |
|---|---|---|---|
| Re. 31,765 | 12/1984 | Guibert | 219/400 |
| 806,475 | 12/1905 | Koneman | 99/446 |
| 1,504,102 | 8/1924 | Davis | 99/445 |
| 2,085,772 | 7/1937 | Soverhill | 219/540 |
| 2,098,295 | 11/1937 | Kettering | 219/400 |
| 2,214,630 | 9/1940 | Wheeler | 219/400 |
| 2,239,957 | 4/1941 | Genda | 219/540 |
| 2,898,437 | 8/1959 | McFarland | 219/400 |
| 3,221,729 | 12/1965 | Beasley et al. | 126/21 |
| 3,474,225 | 10/1969 | Leedy | 219/400 |
| 3,538,904 | 11/1970 | Baker | 126/21 |
| 3,593,647 | 7/1971 | Copeland, Jr. | 99/259 |
| 3,626,922 | 12/1971 | Borge | 126/21 A |
| 3,710,775 | 1/1973 | Tamada et al. | 126/21 A |
| 3,828,760 | 8/1974 | Farber et al. | 126/21 A |
| 3,839,622 | 10/1974 | Mastin | 219/400 |
| 3,884,213 | 5/1975 | Smith | 126/21 A |
| 4,010,341 | 3/1977 | Ishammar | 219/400 |
| 4,154,861 | 5/1979 | Smith | 426/466 |
| 4,226,178 | 10/1980 | Geissler et al. | 99/447 |
| 4,252,055 | 2/1981 | Johansson et al. | 99/386 |
| 4,295,034 | 10/1981 | Assmann | 219/400 |
| 4,327,279 | 4/1982 | Guibert | 219/400 |
| 4,338,911 | 7/1982 | Smith | 126/21 A |
| 4,374,318 | 2/1983 | Gilliom | 219/400 |
| 4,381,443 | 4/1983 | Guibert | 219/400 |
| 4,386,558 | 6/1983 | Holman et al. | 99/386 |
| 4,397,875 | 8/1983 | Gilliom | 426/523 |
| 4,426,923 | 1/1984 | Ohata | 99/468 |
| 4,455,478 | 6/1984 | Guibert | 219/400 |
| 4,462,383 | 7/1984 | Henke et al. | 126/21 A |
| 4,474,498 | 10/1984 | Smith | 432/144 |
| 4,515,143 | 5/1985 | Jabas | 126/21 A |
| 4,576,090 | 3/1986 | Burtea | 99/443 |
| 4,626,661 | 12/1986 | Henke | 219/400 |
| 4,679,542 | 7/1987 | Smith | 126/21 A |

FOREIGN PATENT DOCUMENTS

| | | | |
|---|---|---|---|
| WO87/00261 | 1/1987 | PCT Int'l Appl. | 219/400 |

*Primary Examiner*—Teresa J. Walberg
*Attorney, Agent, or Firm*—Neil M. Rose

[57] ABSTRACT

An electric oven utilizing the recirculation of heated air at high velocity to cook food by impinging jets of such air directly against the food in an oven enclosure of low thermal mass which is divided into a cooking space which separates upper and lower plenums from which air is discharged through nozzle openings in perforated air distribution plates. The oven is provided with air ducts, parts of which are readily disassemblable for cleaning purposes.

41 Claims, 9 Drawing Sheets

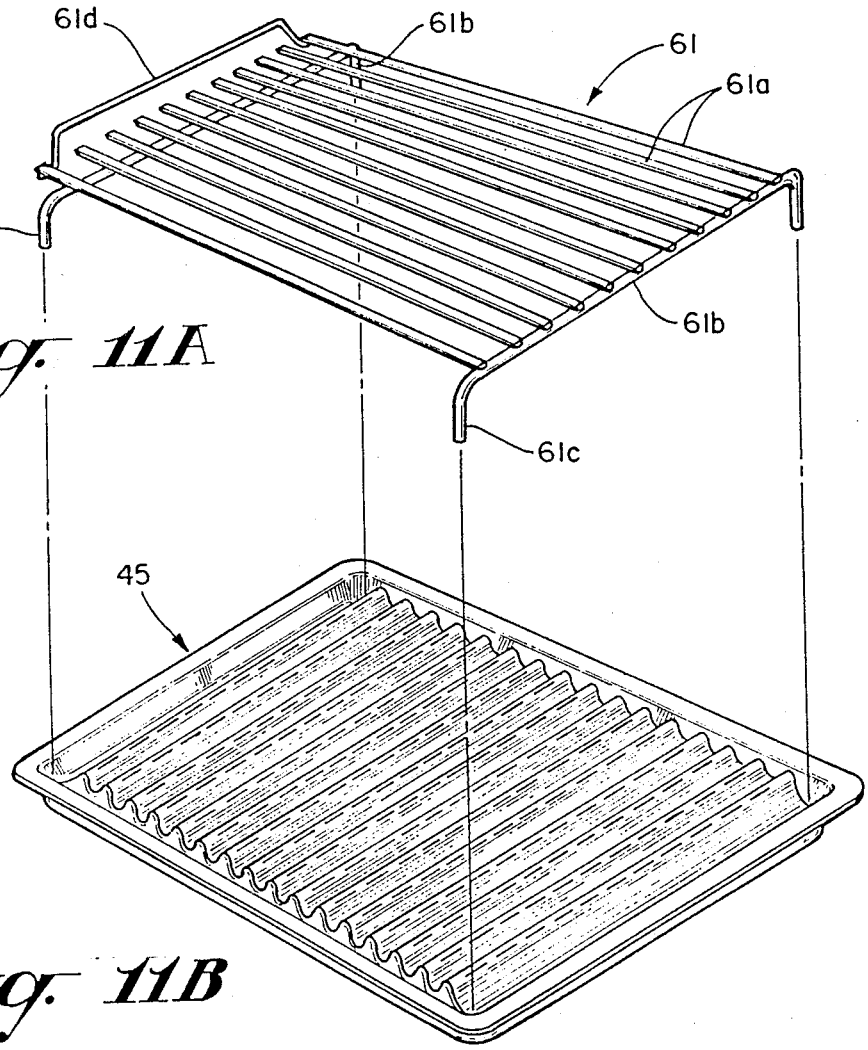
Fig. 11A
Fig. 11B
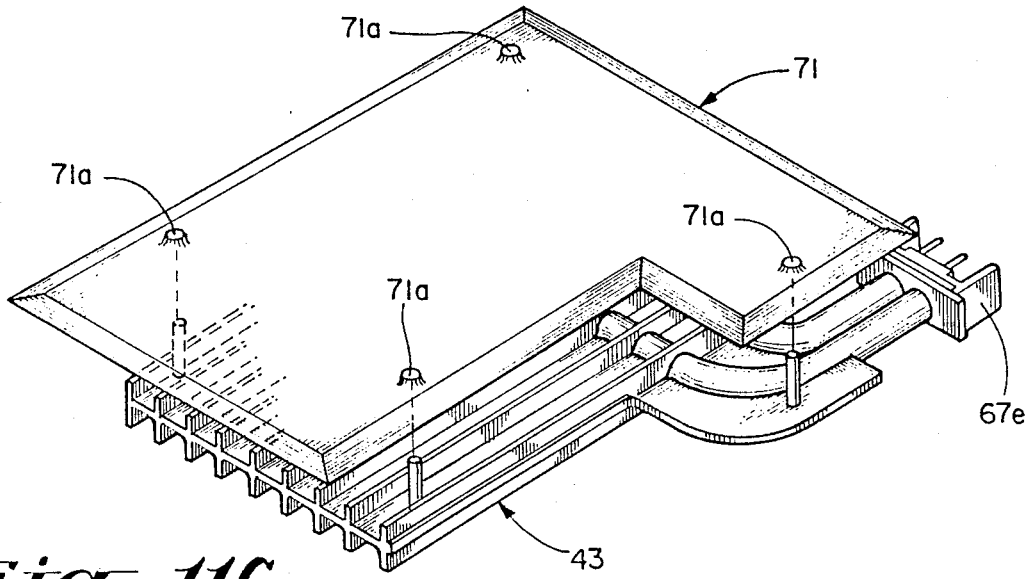
Fig. 11C

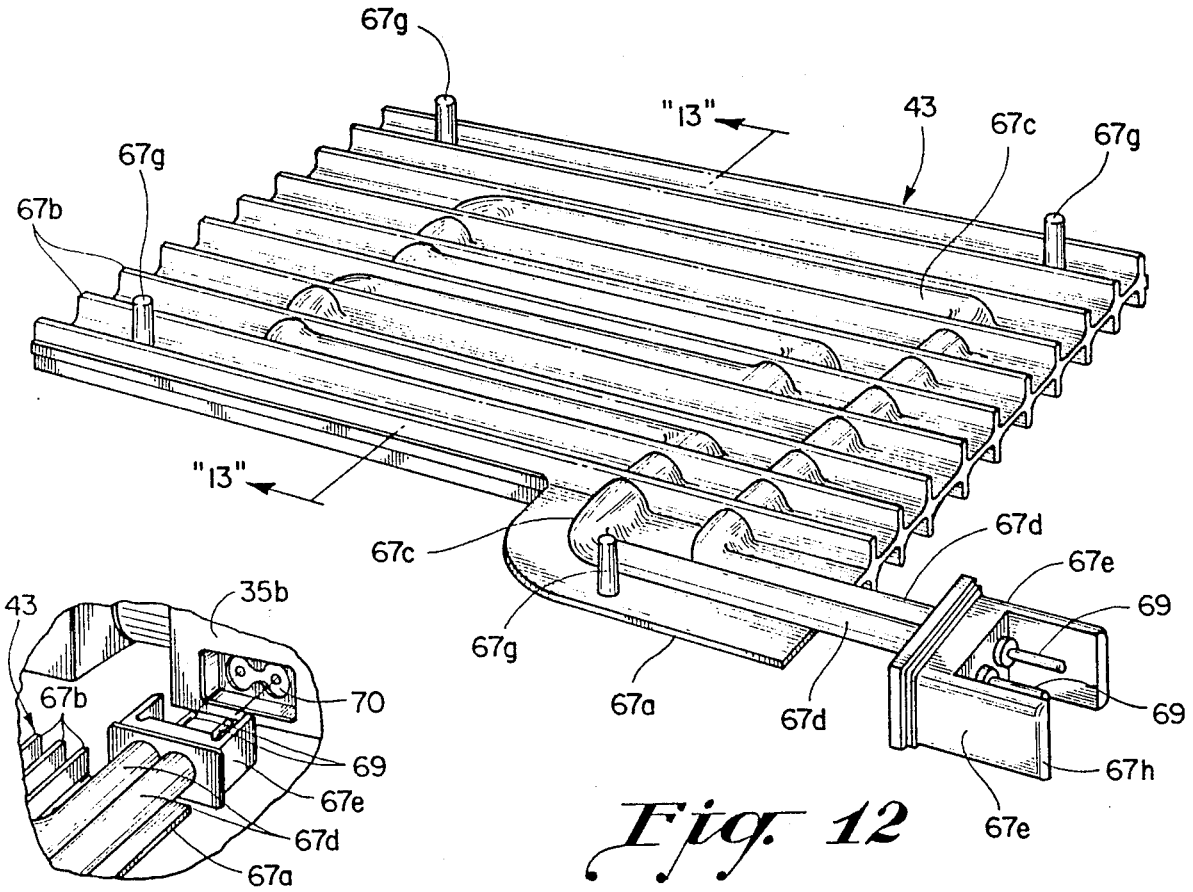
Fig. 12
Fig. 17
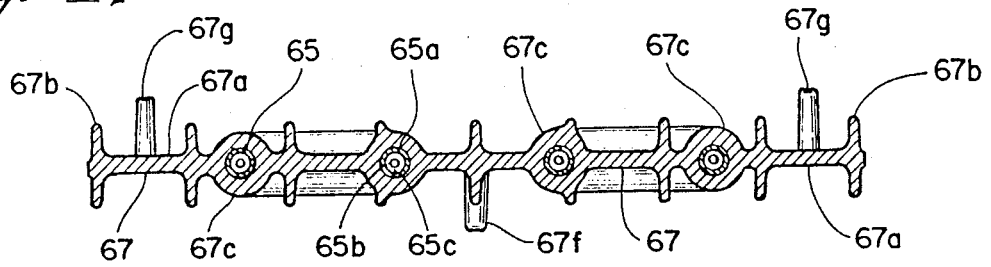
Fig. 13

PORTABLE ELECTRIC OVEN UTILIZING RECIRCULATING HIGH SPEED AIR FOR COOKING

BACKGROUND OF THE INVENTION

The present invention relates to a portable domestic electric oven which utilizes rapidly recirculating heated air for cooking.

Ovens for domestic use are available on the market using a wide variety of cooking principles. The conventional electric and gas ovens which bake and broil by heating the food containing enclosure or radiating heat directly to the food are by far the most commonly used type of domestic oven. Increasing in popularity is the microwave oven which is considerably faster than the conventional ovens in cooking many types of foods. Because of the advantages associated with quick and easy cooking in a microwave oven, it is becoming increasingly common for kitchens to be equipped with the above described conventional gas or electric ovens and with microwave ovens.

In recent years the versatility of the microwave oven has been increased by adding conventional radiant elements to the microwave oven so that foods may be browned in addition to being cooked with microwaves in such combination ovens.

There are also available so-called convection ovens which resemble conventional electric ovens having radiant elements but also include fan means for circulating air within the oven to improve the heat transfer to the food being cooked and thereby speed up the cooking process. This type of air circulation, however, has not had a substantial effect on the cooking times and, therefore, the convection ovens have not been successful in the marketplace.

In order for circulating air to have a substantial effect on cooking times, it is necessary that it be heated to a sufficiently high temperature and circulated at fairly substantial velocities against the food to be cooked. There have been many commercial applications of the principles of cooking utilizing rapidly circulating heated air. Many commercial machines have been sold to restaurant chains and to commercial bakeries utilizing these principles. The patents to Smith U.S. Pat. Nos. 3,884,213; 4,154,861; 4,338,911; Henke, et al. U.S. Pat. No. 4,462,383; Burtes U.S. Pat. No. 4,576,090 and Henke U.S. Pat. No. 4,626,661 are all examples of prior art patents directed to commercial cooking apparatus utilizing high speed recirculated heated air to cook food. The patents teach the concept of directing jets of high speed heated air against the food to be cooked to improve and increase the heat transfer. In many cooking situations, there is a barrier layer of air adjacent the surface of the food which is substantially cooler than the rest of the air in the oven and provides in effect a layer of insulation which slows down or retards the cooking process. The high speed jets of heated air tend to eliminate this barrier and transfer the heat to the food more rapidly, resulting in much faster cooking.

Other examples of forced hot air baking ovens are found in the patents to Beasley, et al. U.S. Pat. No. 3,221,729; Tamada et al. U.S. Pat. No. 3,710,775; Guibert U.S. Pat. No. 4,455,478; and published under the Patent Cooperation Treaty June 15, 1987 under No. WO 87/00261 discloses a domestic electric oven which cooks by the use of recirculated heated air. The patent to Guibert U.S. Pat. No. Re. 31,756 relates to a domestic oven utilizing high velocity heated air flow but pulses the air flow intermittently to accomplish a low temperature cooking of the food. This approach seems to be in distinct contrast to the commercial type cooking apparatus which uses high temperature air and tends to cook the food at the temperature of the recirculated air.

In domestic cooking equipment, it is important that adequate provision and consideration be given the problems of cleaning and the possible problems from smoke generation. In most commercial installations, grease which might be entrained with the air circulating past the food can be trapped in filters or vented through elaborate exhaust systems. However, in the home environment any cooking appliance must be made so that it may be easily cleaned and maintained by the unskilled user of the appliance. In addition, most kitchens have inadequate exhaust systems, so it is necessary that the smoke generated be maintained at a minimum.

BRIEF SUMMARY OF THE INVENTION

The present invention is concerned with a portable domestic oven which cooks by means of recirculating high velocity heated air which is directed on to the food to be cooked. The interior parts of the oven are simple and lightweight to provide a low thermal mass which may be heated quickly to minimize the preheat time required. The interior of the oven is organized with a central food receiving area spaced between upper and lower air distribution plenums. Separating the plenums and the central food receiving zone are two removable air distribution plates which are provided with formed perforations comprising nozzles which direct the air against the food to be cooked. Within the lower plenum there is mounted an air heating element which includes a sheathed heating element encased in a die cast member which has heat exchange fins or radiators formed thereon. The air heater is positioned in the path of the air circulated by a blower mounted on the outside wall of the oven enclosure, there being openings from the central zone into the fan blower so that the fan may circulate air out of the central zone into the lower plenum where it is heated by passing across the air heater.

The fan on the side of the oven enclosure is housed by a removable duct which guides the air axially into the fan and then directs the air thrown outwardly radially of the fan into the lower plenum. The housing and duct for the fan is removable so that it may be readily cleaned of any deposited grease.

In order to facilitate the passage of the heated air from the lower plenum to the upper plenum the side wall of the oven enclosure opposite the fan is formed with a duct which extends the entire depth of the oven enclosure and extends upwardly into the upper plenum. By having the fan direct the air directly into the entrance to the duct to the upper plenum and by having the duct extend the entire depth of the oven enclosure a balanced distribution of air is achieved whereby approximately 40% of the air circulates through the nozzles or apertures in the upper air distributing plate and about 60% of the air is discharged upwardly through the nozzles or openings in the lower air distributing plate. The aforementioned duct is separated from the oven enclosure by a common wall which is detachable from the oven enclosure so that the entire interior of the duct may be readily cleaned of any deposited grease.

In order to minimize the smoke generated within the oven of the present invention, the heating element is operated at a relatively low temperature with a surface temperature on the radiating elements of about 700 degrees Farenheit and a shield is provided above the heating element so that any grease drippage that might pass through the lower air distributing plate would impinge on this shield which is at a temperature of about 500 degrees F. This arrangement of the shield and the relatively low temperature heating element minimizes the generation of smoke within the oven. In addition, the maximum temperature of the air circulating within the oven is maintained below 450 degrees by the thermostatic control means. This again limits the generation of smoke within the oven. The oven enclosure is made of a reasonably lightweight sheet metal, and the outside of the enclosure is well insulated with fiberglass insulation. Because of the low thermal mass of the system, it is possible to heat up the interior parts of the oven enclosure and the air being circulated therein in a relatively short time so that the cooking operation may be begun. Further, by providing substantial insulation, the heat loss during the warm-up period and cooking period is minimized.

Accordingly, it is an object of the invention to provide an improved domestic oven which cooks by means of recirculating heated air which is directed as high speed jets of air against the food to be cooked.

Another object of the present invention is to provide an improved recirculating hot air oven which minimizes smoke generation within the oven by maintaining the air and heating means at relatively low temperatures.

A further object of the invention is to provide an improved oven which cooks by means of recirculating hot air and which, through the use of removable walls and ducts, has all of its interior surfaces accessible for cleaning purposes.

Another object of the present invention is to provide an improved domestic hot air oven which utilizes a low temperature heating element that includes a sheathed heating element enclosed in a die cast member having radiating fins.

Still another object of the present invention is to provide a simplified forced hot air oven utilizing horizontally disposed air distributors to divide an oven enclosure into a cooking space and upper and lower air plenums with the distributors being slotted to direct high velocity streams of air against the food being cooked.

Further objects and advantages of the instant invention will become obvious to one skilled in the art as the following description proceeds, and the features of novelty which characterize the invention will be pointed out in the claims annexed to and forming a part of the specification.

BRIEF DESCRIPTION OF THE DRAWINGS

FIGS. 11A and 11B are perspective views of the food supporting grill and the lower air distribution plate with the two parts shown in vertically separated positions from their normal engaged position;

FIG. 11C is a perspective view of the heating element of the oven with its supporting shield;

FIG. 12 is a perspective view of the air heater;

FIG. 13 is an enlarged sectional view taken on line 13—13 of FIG. 12;

FIG. 17 is a fragmentary exploded perspective showing the manner in which the air heater mounts with respect to the oven cavity;

BRIEF DESCRIPTION OF THE INVENTION

Figure 1:
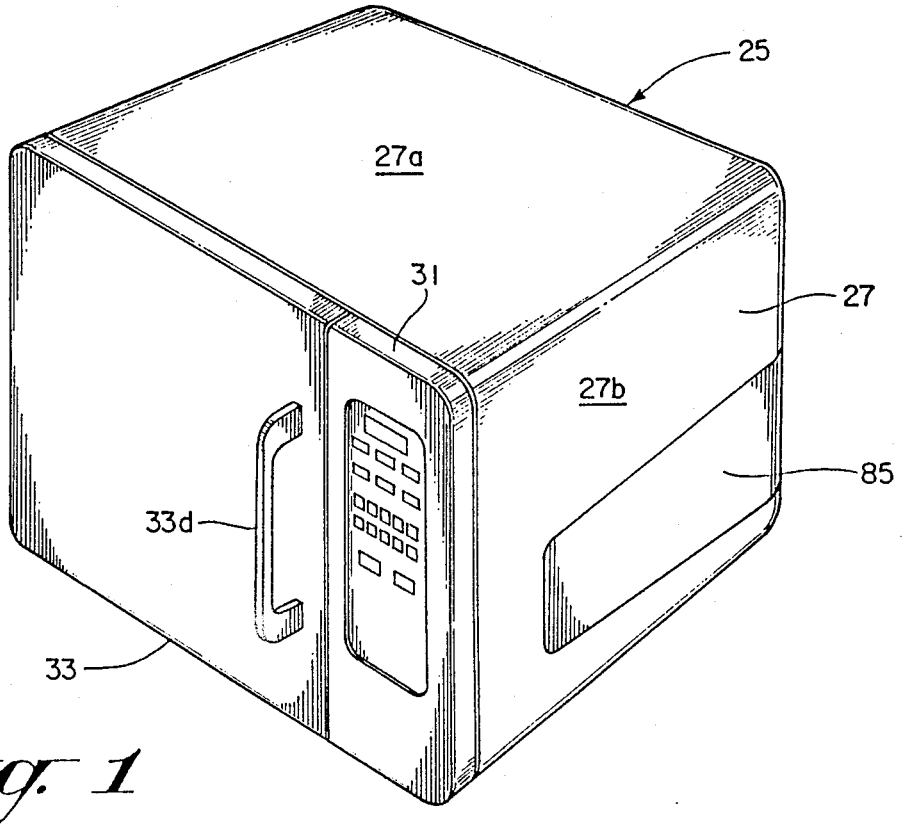
FIG. 1 is a perspective view of a portable electric oven embodying my invention.
Figure 5:
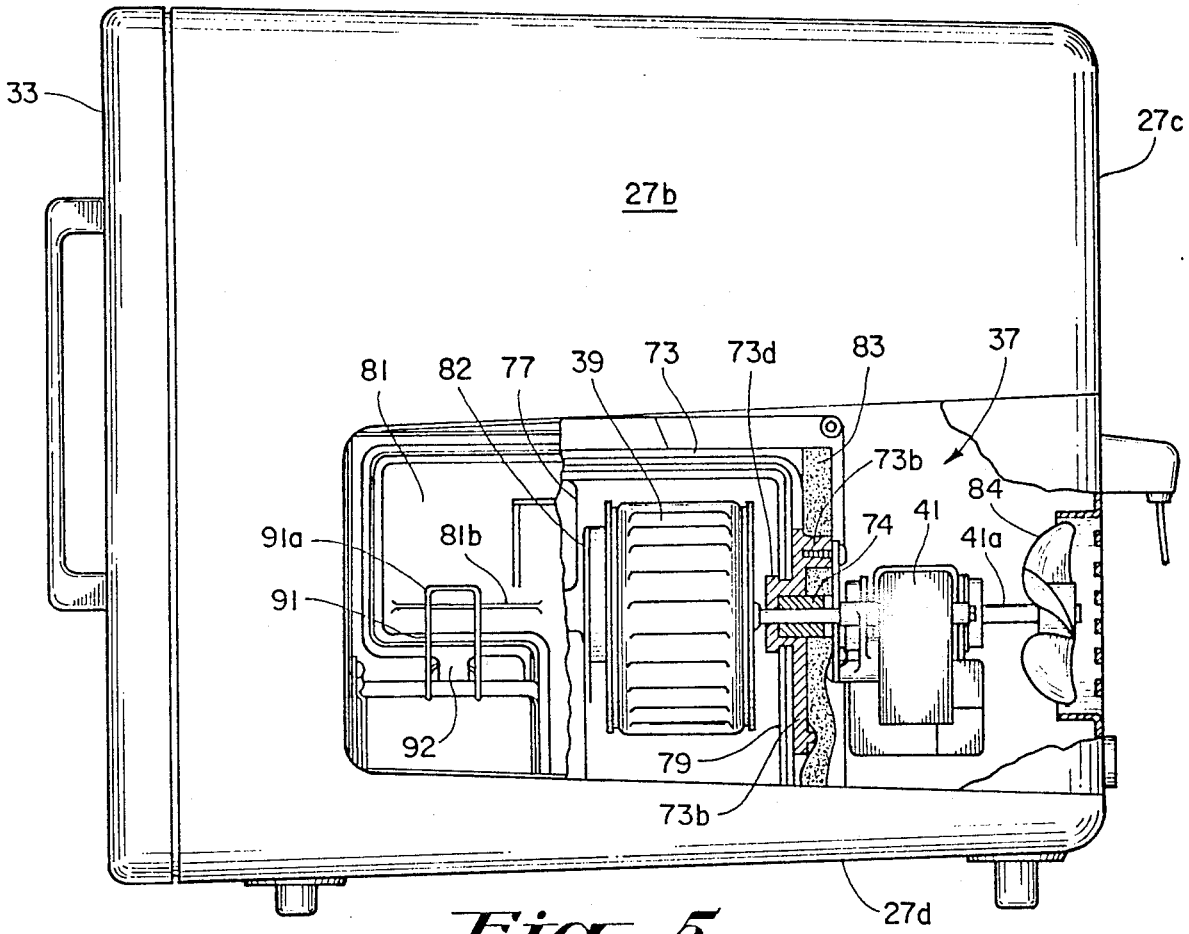
FIG. 5 is a side elevational view of the oven with a portion of the access cover for the fan removed and the air duct associated with the fan also being cut away.

Referring to FIG. 1 of the drawings, there is shown a forced air oven embodying my invention and designated generally by reference numeral 25. The forced air oven 25 is box-like in shape, having an outer housing 27 which is a one-piece plastic molded member having a top wall **27*a*, side walls 27*b* a rear wall 27*c* (FIG. 5) and a bottom 27*d* (FIG. 5). The plastic housing 27 is open on its front side where there is mounted a frame member 29 on which a control panel 31 and a hinged door 33 are mounted. In a preferred embodiment, the housing 27** was molded of thermosetting polyester which was 18% glass filled.

Figure 18:
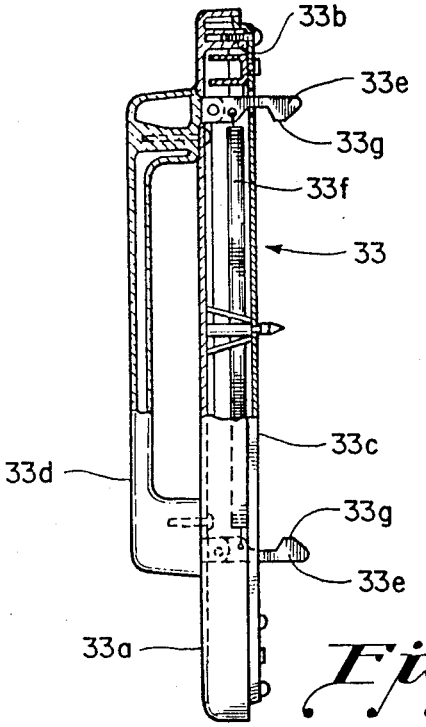
FIG. 18 is a side elevational view of the oven door, a portion being cut away to expose the interior construction thereof.

As is shown in the cutaway view of FIG. 18, the door 33 includes a molded outer door member **33*a* which has integrally molded posts 33*b* for supporting an inner door plate 33*c*. A handle 33*d*, is mounted on the outer face of the door 33 on the edge away from a hinge 34 (FIG. 2. The portion of the handle 33*d* extending into the interior of the door 33 pivotally supports a pair of latch members 33*e* which extend into openings 36 (FIG. 2) in the frame member 29 to latch the door 33 in its closed position. The latch members 33*e* are biased toward each other by a coil spring 33***f*. As the latch members 33*e* enter the openings 36 they are deflected outwardly by cooperating members within said openings 36, and when the door is fully closed, the wedge-shaped ends 33*g* provide a detent action holding the door 33 in a closed and sealed position. In such closed position the door 33 is in sealing engagement with a door gasket 38 (FIG. 2) which prevents air from escaping.

Figure 6:
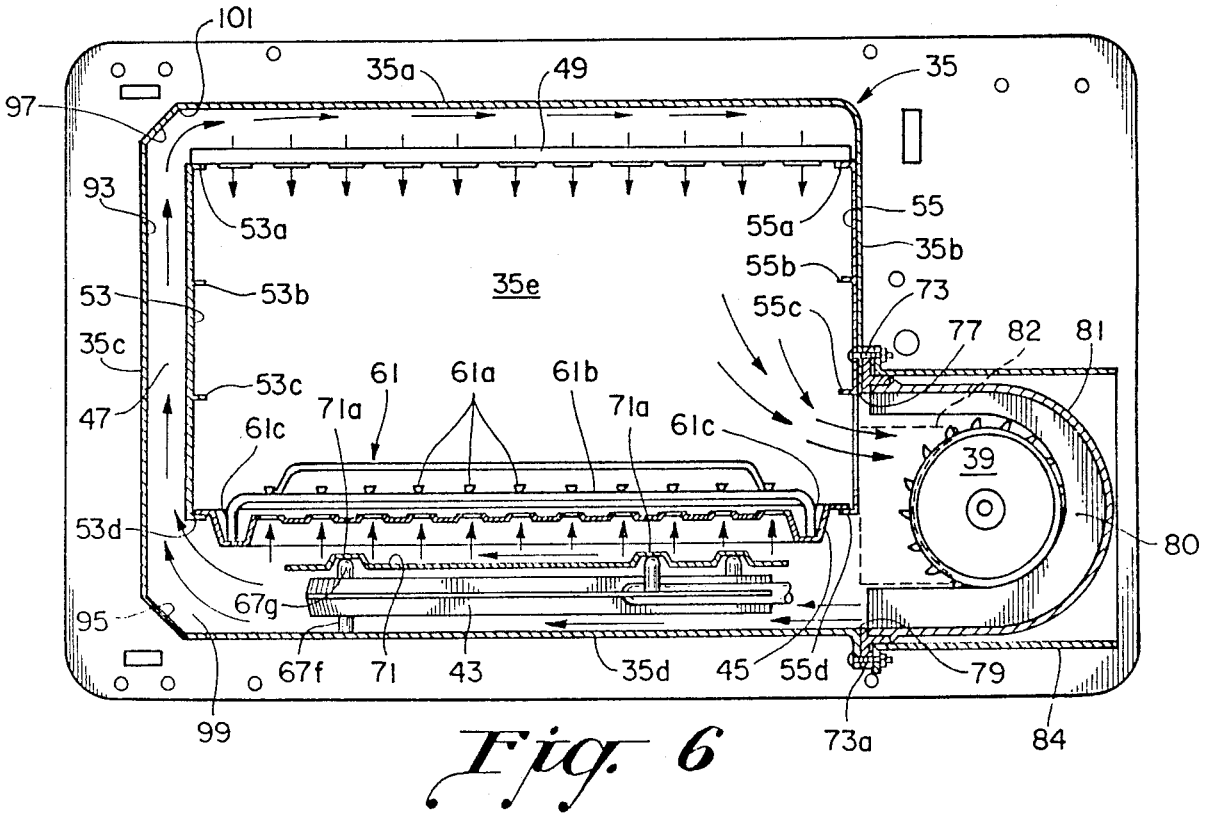
FIG. 6 is a transverse vertical section taken generally through the air distributing fan to illustrate pictorially the manner in which heated air is circulated throughout the oven cavity.

Mounted within the plastic housing 27 is an oven cavity or enclosure 35 which, as best shown in FIG. 6, has a top wall 35*a*, a right side wall 35*b*, a left side wall 35*c*, a bottom wall 35*d*, and a rear wall 35*e*, the front being open and being closed by the door 33 which, as indicated above, engages the gasket 38 to form a relatively air tight enclosure within which high temperature air is re-circulated and directed against the food to be cooked in jets or high velocity streams to enhance and speed up the cooking process. The oven cavity 35 is spaced from the walls of the outer housing 27*a* a sufficient amount to permit a layer of one inch thick fiberglass insulation to be mounted completely around the cavity 35. In a preferred embodiment, the walls of the cavity 35 were constructed of relatively light material being 0.030 inch aluminum coated steel. As will be explained in greater detail below, the efficient operation of the oven 25 requires that the interior parts be of a low thermal mass so that the initial heat-up of the oven may be accomplished in as short a time as possible with the available electrical power. The door 33 is also filled with a one inch thick layer of fiberglass insulation so that the entire cavity 35 is sufficiently insulated to limit the heat loss which would obviously lengthen the heat-up time.

In order to understand the overall function of the oven and how heated air is directed to the food to be cooked, reference should first be made to FIG. 6 which is a vertical cross section taken transversely of the oven 25 looking at it from the front. As shown in FIG. 6, the heated air recirculated within the cavity 35 is moved by a blower 37 which includes a centrifugal fan 39 mounted on an armature shaft 41*a* of an electric motor 41, the fan 39 being shown in FIG. 6 and the motor 41 in FIG. 5. As will be explained in greater detail below, the oven enclosure 35 is provided with openings and duct work which delivers air to one end of the fan 39 so that the air moves axially into the fan 39 and then is thrown out radially as shown by the arrows in FIG. 6.

The air discharged from the fan 39 passes across or in the vicinity of an air heater 43. After passing the air heater 43, the circulating air takes one of two different paths, it either passes directly upwardly through a lower air distributing plate or distributor 45 or passes across the oven enclosure 35 into a vertically extending duct 47 which causes the air to pass upwardly to the top of the oven enclosure 35 at which time it passes horizontally to the right and then downwardly through an upper air distributing plate or distributor 49. The lower and upper air distributors 45, 49 are provided with slots, several of which are shown greatly enlarged in FIG. 16 as slots 51 in the upper air distributor 49, forming nozzles which cause the air to flow in high velocity streams or jets inwardly toward the food which would be positioned in the central portion of the oven enclosure. The heated air which has impinged on the food to be cooked is then withdrawn from the enclosure 35 by the fan 39 and again re-circulated across the air heater 43.

The lower and upper air distributors 45 and 49 are disposed horizontally and extend between the side walls 35*b* and 35*c* and engage the rear wall 35*e* and the door 33 to form two partitions which divide the interior of the enclosure 35 into three distinct spaces, the uppermost of which is termed the upper plenum and the lowermost being termed the lower plenum and the volume between the two air distributing plates is termed the cooking space. The manner in which the air distributing plates are removably mounted within the enclosure 35 facilitates cleaning of the oven and provides a simple means of controlling the air flow while achieving the high velocity streams of air directed against the food to be cooked.

Figures 3, 4:
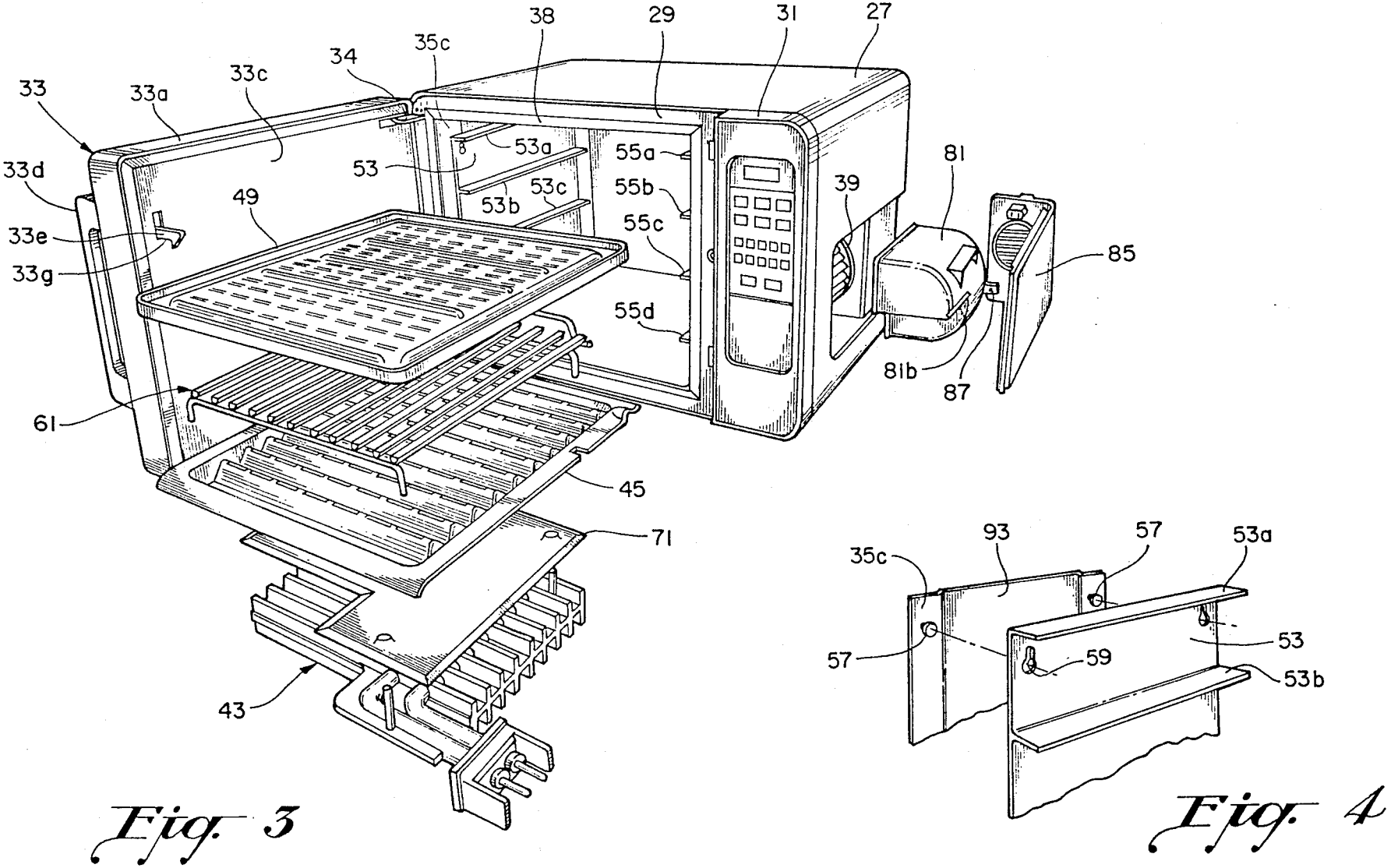
FIG. 3 is an exploded perspective of the oven of FIG. 1 showing the heater, the food supporting means and the various air distribution plates removed from the oven cavity and the air duct associated with the fan removed along with the cover for the access opening in the housing.
FIG. 4 is a fragmentary perspective view showing the support structure of the air distribution plates separate from its wall mounting.

In order to better understand the manner in which the air distributors and the air heater 43 are mounted within the oven enclosure 35, reference should be made to FIG. 3 which shows the oven 25 in perspective with the various removable parts shown disassembled and in their relative but spaced positions in front of the front opening in the oven 25. For the purpose of supporting the air distributors, there are provided removable walls 53 and 55, 53 being on the left and 55 on the right. Each of the removable walls 53 and 55 includes four ledges designated on wall 53 from top to bottom 53*a*, 53*b*, 53*c*, and 53*d* and on the removable wall 55, 55*a*, 55*b*, 55*c*, and 55*d*. Both of the removable walls 53 and 55 are supported in the same manner by means of headed studs 57 which extend through keyhole shaped openings 59 as shown in FIG. 4. Thus, by merely lifting up on either of the side walls 53 or 55 the walls may be moved inwardly, disengaging them from the studs 57 which have heads dimensioned to pass through the enlarged lower portions of the openings 59.

The removable walls 53, 55 are designed to support the lower air distributor 45 on the lowermost ledges 53*d* and 55*d*, as shown in FIG. 6. Carried by the lower air distributor 45 is a food supporting rack 61 which includes a plurality of parallel supporting rods 61*a* secured to transverse bars 61*b* which are formed with supporting legs 61*c*, as is best shown in FIG. 11A. The back edge of the food supporting rack is provided with a horizontally extending rail 61*d* which is slightly above the level of the food supporting bars 61*a* and which prevents foods from sliding off the back edge of the rack 61.

Figure 9:
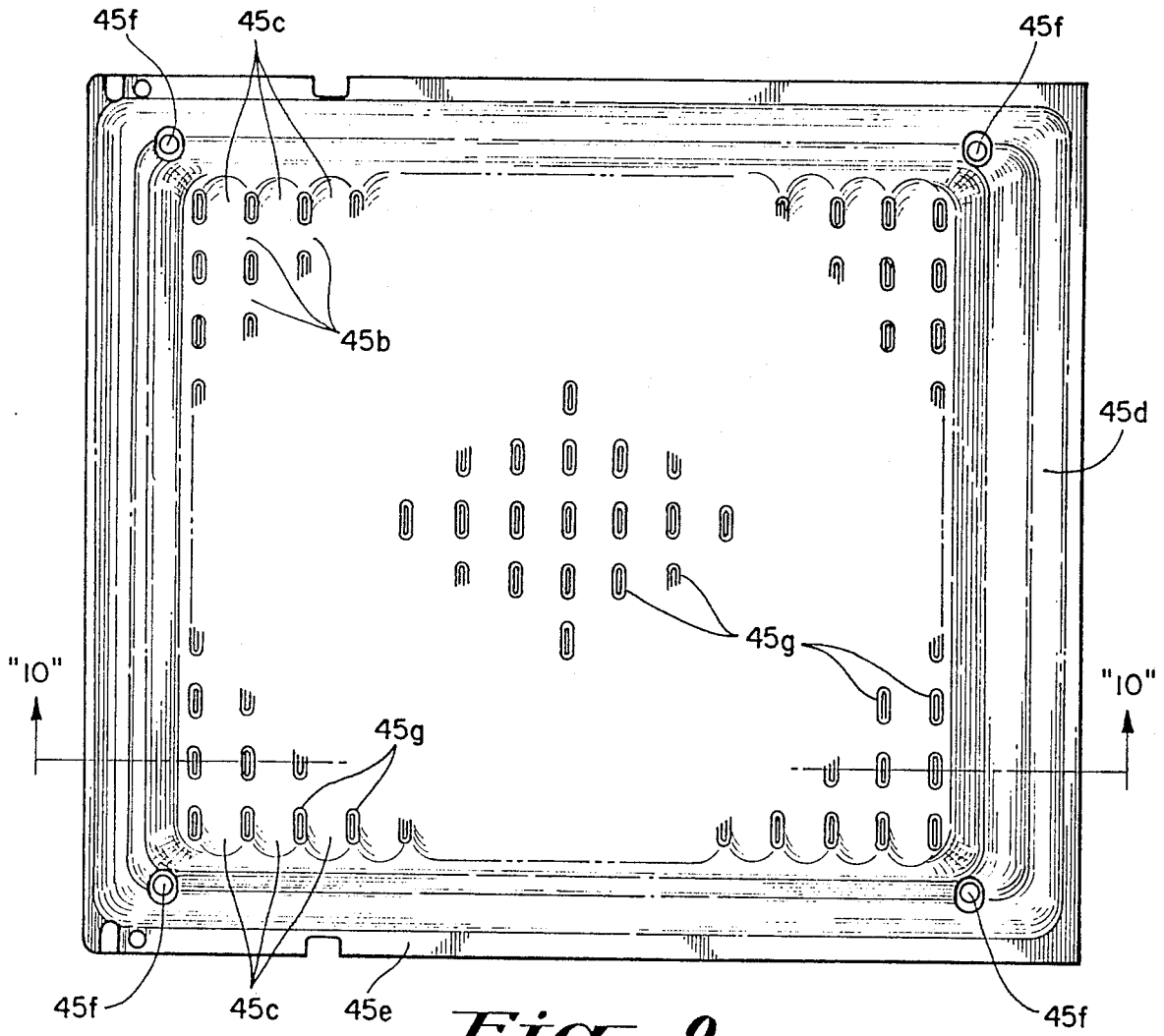
FIG. 9 is a top plan view of the lower air distribution plate.
Figure 10:
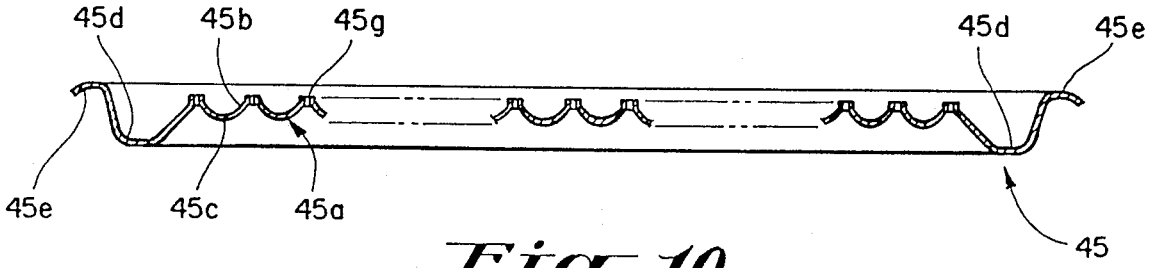
FIG. 10 is a sectional view of the lower air distribution plate taken on line 10—10 of FIG. 9.

In connection with the support of the rack 61 and other functions, the lower air distributor 45 is substantially different in shape from the upper air distributor 49. As best shown in FIGS. 9 and 10, the central portion of the lower air distributor 45 is formed with a corrugated portion 45*a* having ridges 45*b* separated by channel portions 45*c*. Surrounding the entire corrugated portion 45*a* is a peripheral channel 45*d* surrounding which is a peripheral flange 45*e*. Along the edge of the peripheral channel 45*d* there are four slight depressions 45*f* within which the supporting legs 61*c* of the food supporting rack 61 are received.

Between the channels 45*c* and in the ridges 45*b* the corrugated portion 45*a* is formed with rows of slots 45*g*. As may best be seen in FIG. 3, the corrugations 45*a* run across the width of the oven while the food supporting bars 61*a* extend from front to back within the oven enclosure. The slots 45*g* extend across the width of the oven, but the slots in the adjacent ridges or peaks 45*b* of the corrugated portions are aligned in rows from front to back within the oven. It is also noted that each of the front to back rows of slots 45*g* are positioned immediately below one of the food supporting rods 61*a*, as best shown FIG. 6. The purpose of this arrangement is to provide maximum heating to the bars 61*a* which will in turn tend to sear the food supported on the rack 61.

The slots 45*g* are pierced in the tops of the ridges 45*b* and have generally vertical side walls so as to define nozzles which direct the air from the lower plenum upwardly against the food to be cooked in high velocity streams or jets. The slots 45*g* are sufficiently narrow that little grease tends to fall through the lower air distributor 45 into the lower plenum. Most of the grease falls within the channels 45*c* of the corrugated portions 45*a* flowing laterally into the peripheral channel 45*d* from where it may be poured off when required.

To maintain the effectiveness of the cooking action of the recirculating hot air, it is important that the air distributors be positioned as close as possible to the food being cooked. In connection with the lower air distributor 45, this is accomplished by having the food supporting rack 61 arranged to support the food immediately above the slots 45*g* in the corrugated portion 45*a* of the lower air distributor 45.

Since food may differ considerably in its shape and thickness, it is necessary that the upper air distributor be capable of being selectively positioned to maintain the spacing between the upper air distributor 49 and the food at a minimum. In the position shown in FIG. 6 with the upper air distributor 49 supported on the ledges 53*a* and 55*a*, the height of the cooking space is at the maximum which adapts it for receiving large roasts, turkeys and other types of fowl. When grilling steaks, chops or the like, the upper air distributor 49 would e positioned in the lowermost of the three alternative positions, i.e., resting on the ledges 53*c* and 55*c*. In the intermediate position of the lower air distributor 45 on the ledges 53*b* and 55*b*, the arrangement would be suitable for baking cakes and other items of intermediate height or thickness.

Figure 14:
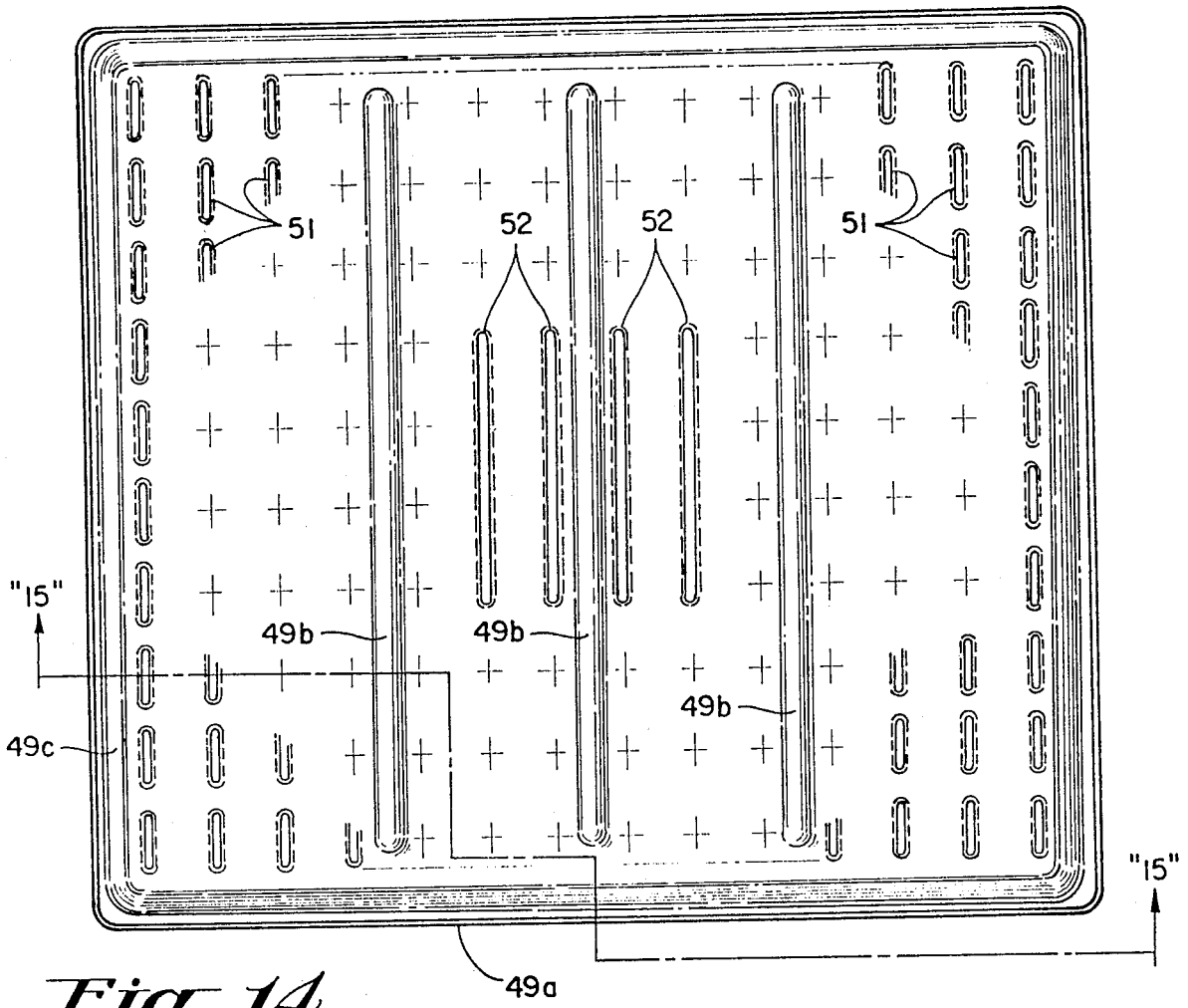
FIG. 14 is a top plan view of the upper air distribution plate.
Figure 15:
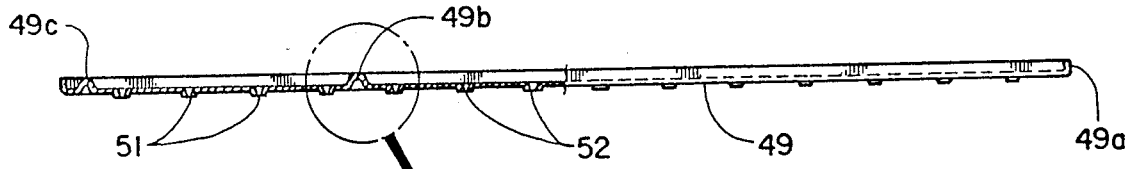
FIG. 15 is a sectional view taken on lines 15—15 of FIG. 14.
Figure 16:
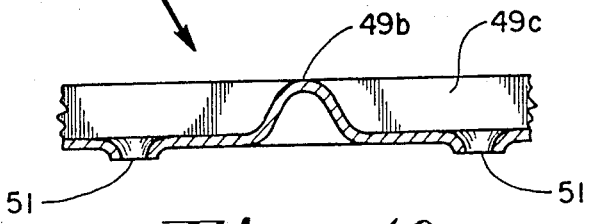
FIG. 16 is a greatly enlarged fragmentary portion of FIG. 15, as indicated.

Turning now to FIGS. 14, 15 and 16, there is shown the detailed structure of the upper air distributor 49. For reasons to be explained briefly above, the parts of the oven 25 which are subjected to the heat of the recirculating air are maintained at as low a mass as possible to reduce the specific heat of all of the parts. For this reason, the upper air distributor 49 is formed with a peripheral upstanding flange 49*a* which, together with transverse ribs 49*b*, tend to increase the rigidity of the light sheet metal from which the distributor 49 is formed. In addition, there is formed immediately inside of the peripheral flange 49*a* an upperwardly formed channel 49*c* which further contributes to the rigidity of the distributor 49. The plate 49 is further formed with a quantity of slots or nozzles 51 described above and a number of elongated slots 52 which are formed with downwardly drawn nozzle portions similar to the nozzles 51 but are more elongated. The purpose of the elongated slots or nozzles 52 is to provide greater air flow toward the center portion of the air distributor 49.

For an understanding of the air heater 43, reference should be made to FIGS. 3, 11*c*, 12 and 13. In order to achieve the objective of providing a smoke free oven having very reduced cooking times as compared to conventional ovens, it is necessary to attain a temperature of the recirculating air of about 420 degrees F. and at the same time utilize a source of heat which would not radiate at a very high temperature. The heated air circulating within the oven 25 will normally contain a certain amount of fats and volatile oils from the food being cooked. If such oils or fats are allowed to encounter a very high temperature heating element, smoke will normally be generated. Since the whole principle of operation of the cooking by recirculating hot air precludes having a vent or exhaust from the interior of the oven, it is extremely important that no smoke be generated since there would be no convenient means of disposing of the smoke. It is a consequence of the foregoing considerations that requires the air heater 43 to be designed to operate at a relatively low temperature.

Referring to FIGS. 12 and 13, the air heater 43 is a horizontally extending die cast member having a sheathed heating element 65 around which a die casting 67 is molded. The sheathed heating element 65 is formed in a tortuous configuration with four spaced parallel portions more or less interconnected at their ends having the appearance of two inverted U-shaped members connected together at the base of their adjacent legs and having the ends of the sheathed heating element being parallel and closely spaced to mount a pair of terminal pins 69 in parallel spaced relationship. The element 65 is of conventional construction having a cylindrical tubular steel sheath 65*a*, a coiled resistance heater 65*b* extending down the central axis of the sheath with compacted magnesium oxide 65*c* supporting the coiled resistance wire in spaced relationship to and insulated from the sheath 65*a*. The terminal pins 69 are mounted in a conventional manner connected to the ends of the coiled elongated resistance wire 65*b* and electrically insulated from the sheath 65*a*.

The die cast member 67 includes a series of web portions 67*a* which join elongated radiators 67*b*, the radiators extending above and below the horizontal plane of the webs 67*a*. In the areas of the die casting 67 within which the sheathed heating element 65 is enclosed, there are enlarged ribs 67*c* which provide a thickened wall surrounding the sheath 65*a* The die cast ribs 67*c* enclosing the sheathed heating element extend above and below the central plane of the web 67 as may be best seen in FIG. 13. The tortuous configuration of the sheathed heating element within the ribs 67*c* may be seen from FIG. 12. As may be seen in FIG. 12, the ribs 67*c* extend beyond the web 67*a* in the area of the terminals 69 forming cylindrical portions 67*d* which extend into a die cast terminal guard 67*e*. The terminal guard 67*e* is of somewhat U-shape configuration having legs 67*h* which are parallel to and extend along side the terminal pins 69.

In a preferred embodiment of the oven 25, the sheathed heating element 65 has a power rating of 1400 watts when operated at 120 volts and under normal conditions of continuous operation would attain a surface temperature of around 1000 degrees F. However, by enclosing the sheathed heating element 65 and surrounding it with the die casting 67 with its various heat radiating fins 67*b*, the air heater 43 operates at a considerably lower temperature than one would have with an exposed sheathed heating element. The temperatures on the air heater 43 when operated within the oven enclosure 35 with the blower 37 operating are normally less than 700 degrees F.

Figure 2:
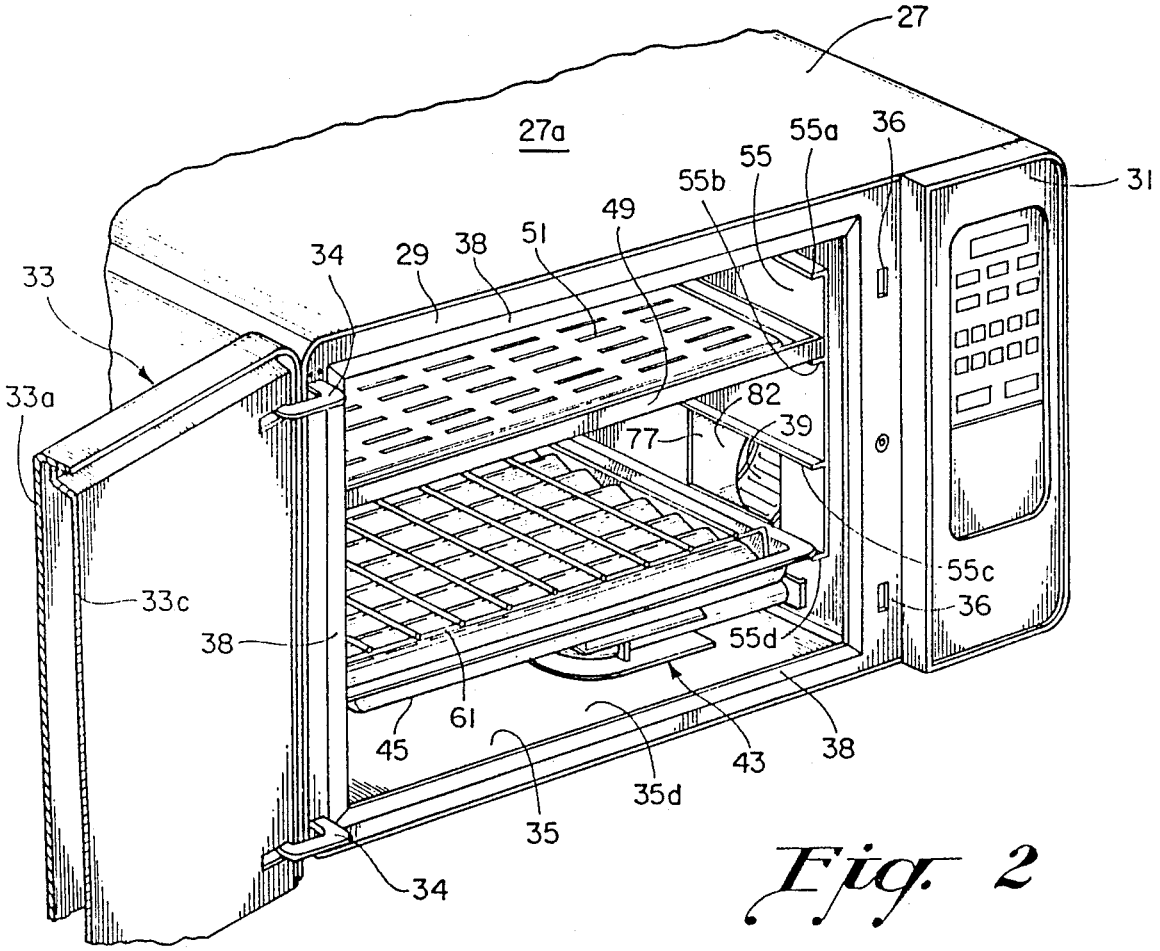
FIG. 2 is a fragmentary perspective view of the oven of FIG. 1 with the door open, exposing the interior of the oven.

As may be seen in FIG. 2, the air heater 43 mounts with its terminals extending into the side wall 35*b*. Plug connections are provided so that the air heater 43 may be detachably connected to a power receptacle 70 mounted within the wall 35*b* as illustrated in the fragmentary perspective of FIG. 17. To support the end of the air heater 43 remote from the terminal connection, there is provided a downwardly extending leg or protuberance 67f which is a portion of the die casting 67. The leg 67f rests on the bottom wall 35d as is best shown in FIG. 6. Extending from the upper surface of the die casting 67 are four posts 67g, best shown in FIGS. 12 and 13. The posts 67g serve to receive and support a heater shield or drip shield 71. The shield 71 has four small drawn cup-like portions 71a which receive the posts 67g and locate the shield 71 with respect to the air heater 43 and assure that the shield is aligned coextensive with and above the air heater 43. The purpose of the shield 71 is to prevent any grease drippings which might pass through the air discharge slots 45g in the lower air distributor from falling onto the air heater 43. Even though the design of the air heater 43 is such that it radiates at a relatively low temperature on the order of less than 700 degrees F., there would still be some tendency for grease falling directly on the air heater 43 to carbonize and turn into smoke. By utilizing the shield 71 which is positioned in the circulating air stream, a temperature gradient results wherein the shield is at a temperature of about 500 degrees F. At this temperature, no smoke generation would result in the event that grease falls on the shield 71.

Figure 7:
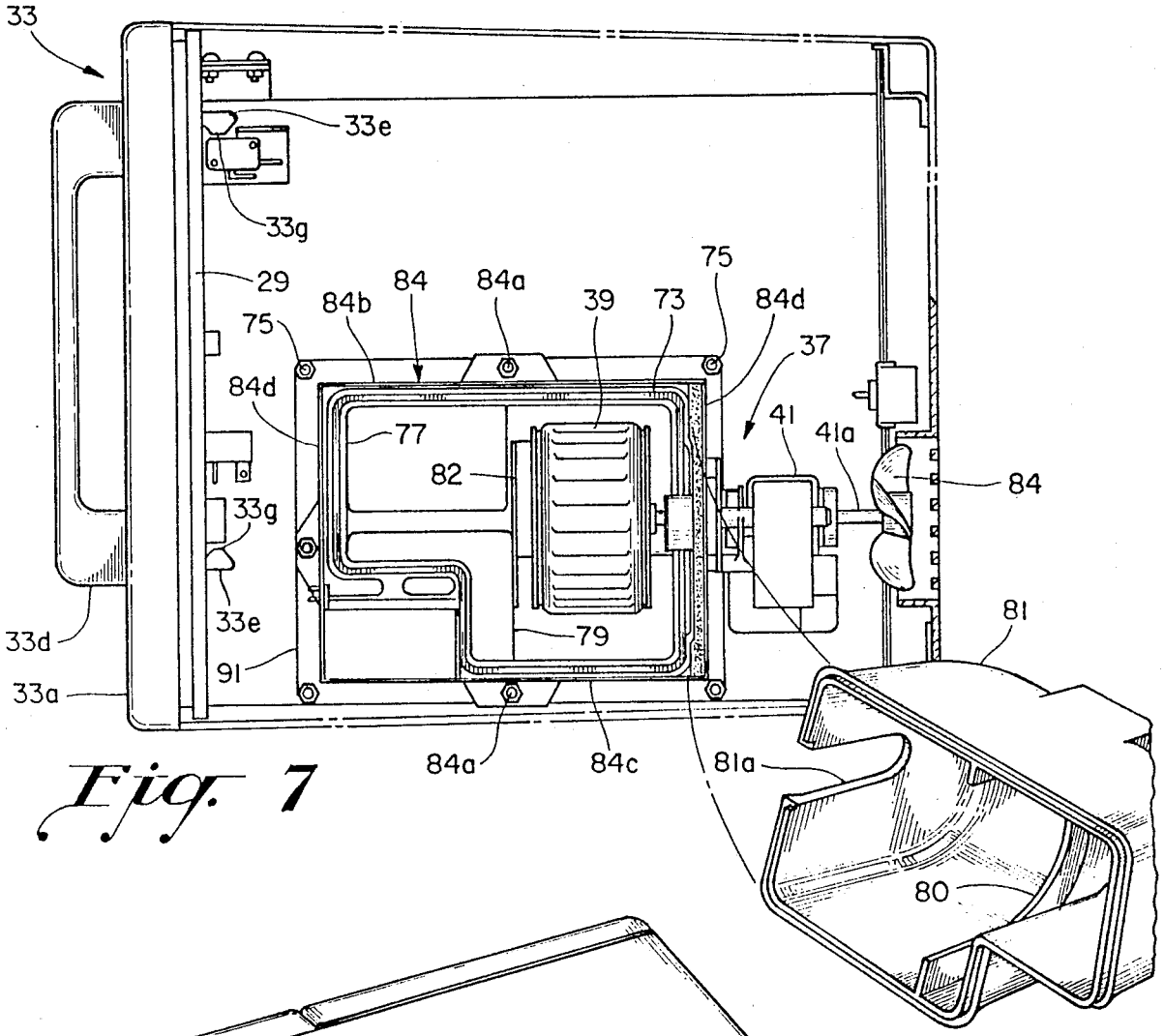
FIG. 7 is a side elevational view of the oven with the outer housing and fan duct removed showing the air blower, including the motor and fan with the fan duct in a disassembled position.
Figure 8:
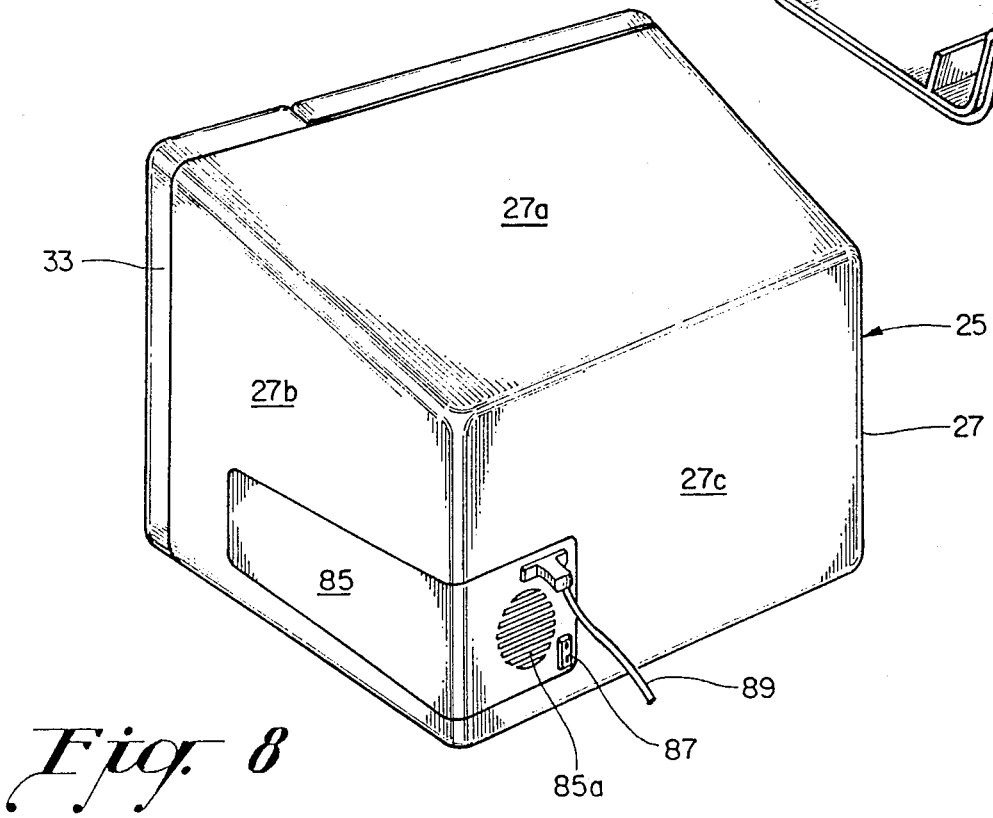
FIG. 8 is a rear perspective view of the oven.
Figure 19:
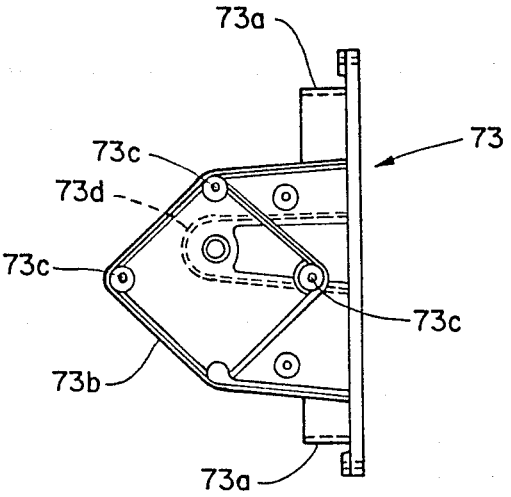
FIG. 19 is a rear elevational view of the frame member which mounts the air blower for the oven.

The blower 37 has been described generally as serving to circulate the heated air from the central cooking space within the oven enclosure 35 across the air heater 43 and into the lower air plenum and also into the upper air plenum, the jets of air being discharged from the upper and lower air plenums through the air distributors 45 and 49 back into the cooking space. The blower 37 is mounted by means of a die cast frame 73 which is secured to the side wall 35b by means of bolts 75, as shown in FIG. 7. The frame member 73 is disposed generally vertically and extends around an air outlet opening 77 formed in the side wall 35b of the oven enclosure 35 and is best shown in FIGS. 6, 7 and 19. The outlet opening 77 permits the air exhausted from the cooking space in the oven enclosure 35 to be drawn out in the area adjacent to the forward end of the centrifugal fan 39, the air then moving rearwardly axially of the fan into the center of the fan from where it is thrown out radially as shown best in FIG. 6.

The wall 35b is also formed with an inlet opening 79 shown in FIGS. 5, 6 and 7. It should be understood that the inlet opening 79 is located generally radially outwardly and somewhat below the centrifugal fan 39 and that it is displaced rearwardly of the outlet opening 77. The schematic sectional view of FIG. 6 may be confusing in that it makes it appear that the outlet opening 77 is immediately above the inlet opening 79 whereas they are actually displaced as is evident from FIG. 7.

The frame member 73 (shown best in FIG. 7 and in the rear elevational view of FIG. 19) has a stepped wall 73a which extends around the open central portion which encloses the openings 77 and 79. At the rear edge of the frame member 77 there is an outwardly extending wall 73b to which the motor 41 of the blower 37 is mounted by bolts extending through openings 73c. The motor 41 includes an armature shaft 41a which supports the fan 39. The frame member 73 and wall 73b is formed with a bearing support portion 73d which supports a shaft bearing 74, as shown in FIG. 5.

For the purpose of directing air from the outlet opening 77 through the fan 39 and then through the inlet opening 79 there is a fan shroud 81 which is shown in FIGS. 3, 6 and 7, FIG. 5 being shown with the fan shroud partially cut away and FIGS. 3 and 7 having the fan shroud 81 shown in an exploded or spaced position from its normal mounting. In its operative position, the fan shroud 81 is positioned in engagement with the stepped wall 73a of the frame member 73 forming a complete enclosure around the fan 39 and the openings 77 and 79. The fan shroud 81 has a cutout portion 81a which is adapted to seal against the bearing support portion 73d that is positioned between the motor 41 and the fan 39. This provides an enclosure for the fan 39 with the motor 41 mounted exteriorly of the enclosure so that the motor is not exposed to the high temperature air circulating within the oven enclosure 35. As is evident from FIG. 5, there is provided an insulating barrier 83 which extends between the fan shroud and the motor 41. Axial flow fan 85 carried by the motor armature shaft 41a serves to cool the motor 41.

In order to keep the air flow going into fan 39 axially from the front separate from the air leaving the fan radially and outwardly through opening 79, there is a wall extending perpendicular to the fan axis. This wall is formed by an annular wall 80 located within the fan shroud 81 and a wall 82 mounted on removable wall 55 and extending into the fan shroud 81. Wall 82 is shown in dashed lines in FIG. 6 and is also shown in FIGS. 2 and 7. It forms with wall 80 a barrier that allows the air to enter fan 39 through the front end as shown in FIG. 6.

Surrounding the fan shroud 81 is a sheet metal partition 84 which is secured to frame member 73 by bolts 84a as shown in FIG. 7. The partition 84 extend completely around the shroud 81 abutting the frame member 73 having a top wall 84b, bottom wall 84c and side walls 84d and serves to support insulation around the fan 39 while still permitting the shroud 81 to be removed.

The plastic housing 27 of the oven 25 is formed with a somewhat L-shaped removable panel 85 which may be removed from its mounted position by actuating a latch 87, permitting its removal as shown in FIG. 3. A power cord 89 extends through the panel 85 to provide an interlock removing power to the oven when the panel 85 is removed. The panel 85 is also provided with air inlet openings 85a through which cooling air is drawn by the fan 84 to cool the motor 41.

The purpose of having the panel 85 removable is to provide access to the fan shroud 81 which is retained in position on the frame member 73 by means of a bail type latch 91 (FIG. 5). The latch 91 is pivotally connected to a bar 92 formed on the frame member 73 and includes a hook shaped end portion 91a which applies a resilient biasing force inwardly on the shroud 81 to retain it in its mounted position sealed against the frame member 73. The latch 91 snaps across a ridge 81b, best shown in FIG. 5.

Figure 20:
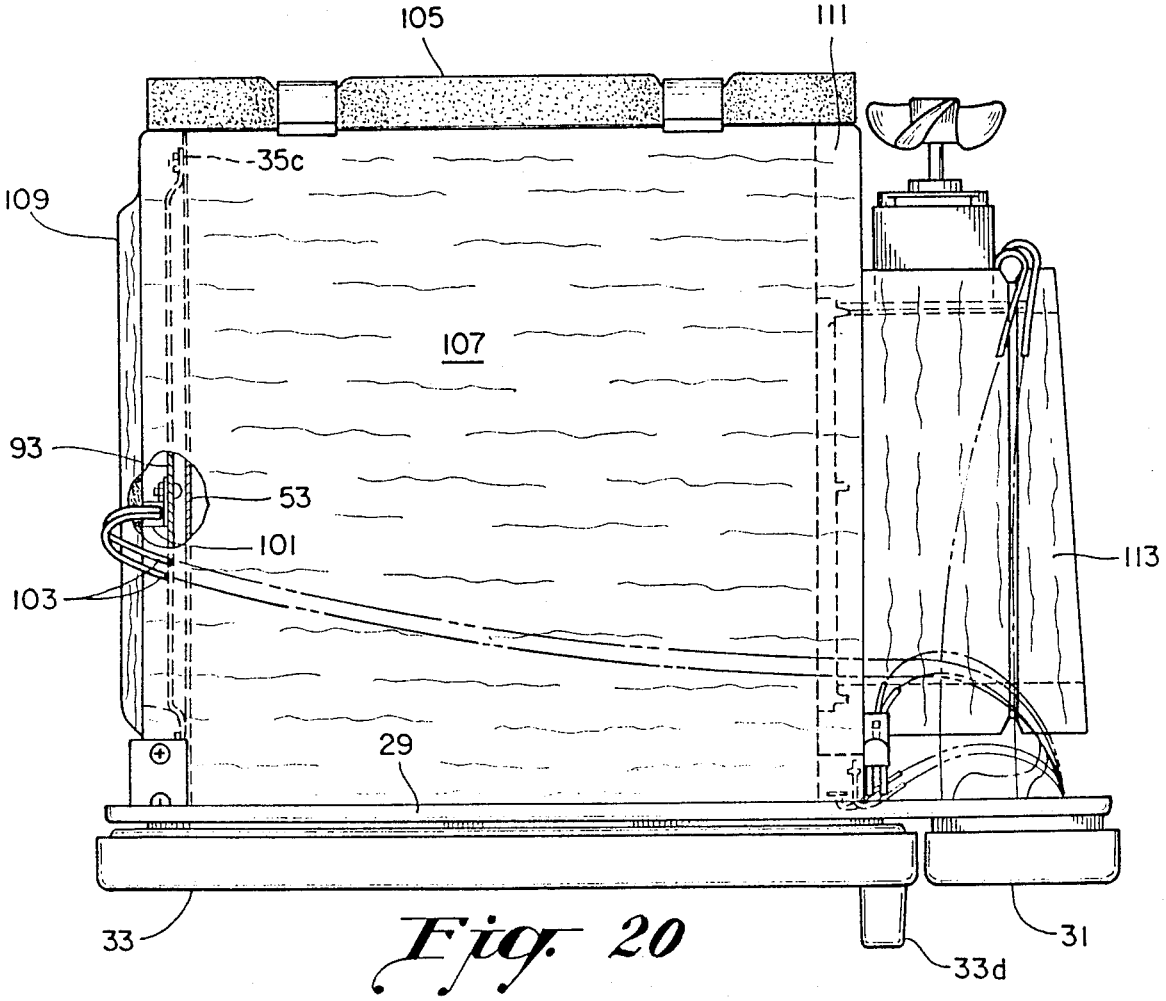
FIG. 20 is a top plan view of the oven with the outer plastic housing removed.

Described generally above was the vertical air duct 47 which carries the heated air from the lower air plenum beneath the lower air distributor 45 to the top of the oven enclosure 35 above the upper air distributor 49. As is evident from FIG. 4 and FIG. 20, the left wall 35c of the oven enclosure 35 is formed with a depressed central portion 93 which extends almost the entire width of the removable wall 53. This provides a duct 47 which is of an extent in depth almost equal to the removable wall 53 to allow a substantial air flow from the lower air plenum to the upper air plenum, as is shown in FIGS. 6 and 20. At the lower end of the wall 35c there is a beveled portion 95 which tends to deflect the air upwardly into the duct 47 and at the top there is another angled wall 97 which tends to deflect the vertically moving air in a horizontal direction across the upper air distributor 49. The air duct 47 may be considered to have an entrance opening 99 and a discharge opening 101.

To make the oven 25 useful and feasible for domestic use, it is important that it be easily cleaned and maintained. By reducing the surface temperature at which the air heater 43 operates, smoke is essentially eliminated from the system. However, as long as foods containing fats and greases, such as steaks and chops, are cooked in an oven, any air circulated across these foods will contain entrained particles of vaporized or partially vaporized fat or grease. In a conventional oven, this type of material tends to deposit on the walls of the oven. Because of the requirement for the re-circulation of the heated air to obtain the other advantages inherent in the oven 25, there are the parts associated with this air circulation which must also be made easily accessible for cleaning purposes. It is for that reason that the fan shroud 81 is made readily removable so that it may be placed in the dishwasher for cleaning purposes or otherwise treated to remove grease that may deposit on the inside walls of the fan shroud 81.

Similarly, there is the possibility that grease will deposit within the vertical duct 47. With the removal of the wall 53, the entire interior portion of the duct 47 is exposed for cleaning purposes so that it might be wiped clean as easily as the side walls of a normal oven. It is also noted that the right hand removable wall 55 may also be easily detached and removed for cleaning purposes. When the user of the oven has removed the lower air distributor 45 along with the food supporting rack 61, the upper air distributor 49 and the air heater 43 and the shield 71, the interior of the oven enclosure 35 is completely free of obstructions that would prevent one from readily cleaning the oven. Accordingly, there is provided a forced air oven having means for rapidly circulating heated air with the entire system of ducts and nozzles being such that they are easily accessible for cleaning purposes.

The control panel referred generally above as 31 includes the typical time and temperature controls and the particular form is not pertinent to the inventive concept disclosed and claimed herein. As shown in FIG. 20, the temperature control is accomplished by means of a thermistor 101 mounted on the outer wall **35*c* of the oven enclosure, and more specifically, on the portion of that wall defining the duct 47 which transfers the ar from the lower air plenum to the upper air plenum. Suitable leads 103 connect the thermistor 101 to the control panel 31 so as to regulate the air temperature to some preselected value. The temperature control, including the thermistor 101, then switches on and off or cycles the air heater 43** so as to maintain the preselected temperature. The means for accomplishing such temperature regulation in response to a thermistor output is conventional and well known in connection with conventional ovens, and, therefore, is not disclosed in detail herein.

The location of the thermistor on the side wall of the duct 47 is designed to produce a somewhat average air temperature response since the air temperature will be hotter in the lower air plenum and slightly cooler in the upper air plenum. In addition, the positioning on the outer wall of the duct 47 spaces the sensor well away from the air heater 43 which would distort the response of the control means.

The temperature control for the oven 25 in the preferred embodiment allows the user to select the various functions of GRILL, BAKE, DEFROST, SLOW COOK and KEEP WARM as encompassing any of the functions required in connection with the use of the oven. By selecting any one of these functions on the control panel, the controller provides, respectively, the temperatures of 420 degrees F.; 385 degrees F.; 325 degrees F.; 210 degrees F. and 150 degrees F. Thus, if the user of the oven desired to bake a cake or cook a roast, she would select the BAKE function, causing the thermistor 101 and its temperature control to maintain the air heater 43 in operation until the air temperature reached 385 degrees F., at which time the control would cause the air heater 43 to cycle on and off to maintain the temperature at that level.

As indicated above, the effective operation of the oven 25 in cooking more rapidly than conventional ovens requires that the oven cavity 35 be heated up very rapidly since the air and all of the walls within the enclosure 35 must be heated to an elevated temperature before effective cooking may commence. Accordingly, the walls of the cavity or enclosure 35 are made of relatively light weight material on the order of 0.030 inches in thickness, as are the movable walls 53 and 55 and the upper and lower air distributors 45 and 49. In addition, to prevent the escape of heat from within the oven enclosure 35, all of the walls of the oven enclosure are faced with one inch fiberglass insulation, as shown in FIG. 20. There is a vertically extending piece 105 adjacent the rear wall **35*e*, a horizontal piece 107 on the top facing the wall 35*a*, and vertical side pieces 109 and 111, as shown in FIG. 20. The above-described construction provided in the preferred embodiment an insulation R value of 4.3 hours.feet squared.degrees F./British Thermal Unit. A separate piece 113 is wrapped around the partition 84 which surrounds the duct 81. This combination of the light weight or low specific heat parts making up the enclosure 35 and its associated parts and the heavy insulation around the oven enclosure permit the oven 25** to be heated up to operating temperature in a relatively short time. For example, the heat-up time to the grill temperature of 420 degrees F. requires only 22 minutes. The heat-up time to the temperatures for performing the other functions are correspondingly lessened.

The interior walls of the oven cavity 35 are coated with a nonstick finish to facilitate cleaning. Such finishes are commonly used in connection with conventional ovens, but in general, they fail to stand up because of the high temperatures to which they are subjected. Since the air temperature circulating within the oven enclosure 35 do not exceed 430 degrees F., there is no problem in maintaining the nonstick finish on the walls of the oven enclosure.

The fan 39 in the preferred embodiment circulated air at the rate of 1200 feet per minute through the outlet opening 77 and at the rate of 2000 feet per minute through the inlet opening 79. The ratio of the air through the upper distributor 49 as compared to that to the lower distributor 45 in the preferred embodiment was on a ratio of about 3 to 7. The air velocity issuing from the jets in the air distributors was on the order of 300 to 750 feet per minute.

Of the various advantages flowing from the use of high speed circulating hot air to cook are the (1) shortened cooking times resulting from breaking down any insulating barriers of air adjacent the food to be cooked, (2) lack of an out of the food, and (3) absence of need to turn food over since it coooks from both sides. With respect to the lack of drying out of the food, it has been determined that the air being re-circulated initially picks up some moisture from the food and, thereafter, tends to cook the food without drying it out because of the high moisture content in the circulating air.

I claim:

1. A force air oven which cooks by means of heated recirculated air comprising a box-like housing having vertical side walls, top and bottom walls, forming an oven enclosure and having a front opening closed by a door hingeably connected to said housing for movement between a position closing said opening and an open position permitting access to said enclosure, a pair of perforated plates forming upper and lower horizontal partitions in said enclosure dividing said enclosure into an upper plenum and a lower plenum separated by a cooking space, a blower supported on one of said side walls and air ducts for circulating air out of said cooking space into said blower and out of said blower into one of said plenums, and a duct formed in one of said side walls to transfer air from said one plenum to the other of said plenums, said perforated plates extending between spaced side walls of said oven and between said door and the side wall opposite said door, support means on said side walls for supporting said perforated plates in a plurality of selectable vertically spaced positions to vary the height of said cooking space, said perforated plates being removable through said opening to select the vertical positions for said perforated plates.

2. The forced air oven of claim 1 wherein said blower circulates air into said lower plenum, a horizontally disposed air heater in said lower plenum, said air heating including an elongated sheathed electric heating element having radiating elements on said sheathed heating element to increase the rate of heat transfer between said air heater and the air passing through said lower plenum.

3. The forced air oven of claim 2 wherein said radiating elements are formed by a die casting which encloses said sheathed electric heating element and is formed with a plurality of radiating fins extending above and below the horizontal plane in which said sheathed heating element is disposed.

4. The forced air oven of claim 3 wherein said sheathed heating element is formed in a tortuous configuration with a plurality of parallel legs interconnected by transversely extending segments, said die casting including a flat generally horizontal plate portion enclosing said sheathed heating element and having said radiation fins extending vertically upwardly and downwardly from said plate portion.

5. The forced air oven of claim 4 wherein said air circulated into said lower plenum is discharged from said blower across said air heater into engagement with said radiating fins above and below said plate portion, said radiating fins being elongated and extending in the direction of air flow across said air heater.

6. The forced air oven of claim 5 including a heater shield supported on said air heater and disposed horizontally between the lower of said perforated plates and said air heater, said shield being a flat plate coextensive with said air heater and being supported by upstanding projections on said die casting.

7. The forced air oven of claim 1 wherein said pair of perforated plates include a lower air distributor and an upper air distributor, said lower air distributor having a raised peripheral flange and grease trough extending around the periphery inwardly of said flange, said lower air distributor being formed with a corrugated central portion elevated above said trough so that grease deposited on said corrugated portion will drain into said trough, said corrugated portion having parallel channels separated by peaks having air discharge slots formed therein.

8. The forced air oven of claim 7 wherein said lower air distributor supports a grill in said oven, said grill including a plurality of parallel rods forming a horizontally extending support surface coextensive with said corrugated central portion of said lower air distributor, legs extending downwardly from the corners of said grill for engagement with said trough to mount said grill in spaced parallel relation to said corrugated central portion of said lower air distributor.

9. The forced air oven of claim 8 wherein said upper air distributor comprises a generally flat horizontally disposed plate having a peripherally disposed upstanding flange and an adjacent channel to strengthen said plate against deflection, parallel rows of slots formed in said plate in the area within said channel, each said slot having a nozzle portion extending below said plate to direct air flowing therethrough in a vertical direction, said plate having strengthening ribs extending transversely on said plate between said rows of slots.

10. The forced air oven of claim 1 having an air heater disposed in said lower plenum, said blower circulating air across said air heater to heat the air circulated through the upper and lower perforated plates, said duct in said one side wall extending from adjacent said front opening to the side wall opposite said front opening and from said bottom wall to said top wall, said upper and lower perforated plates each engaging continuously three side walls and the inside surface of said door when closed to seal said cooking space so that said circulating air enters said cooking space only through the perforations in said upper and lower plates.

11. The forced air oven of claim 1 wherein said blower includes a fan and motor drivingly connected to said fan, said motor and fan being mounted on the outside of said one side wall, said one side wall being formed with an air outlet opening located in said cooking space and adjacent to said fan to permit said fan to draw heated air out of said oven, said one side wall being formed with an air inlet opening in said lower plenum and adjacent to said fan to permit said fan to circulate air into said lower plenum.

12. The forced air oven of claim 1 wherein said pair of perforated plates include a lower air distributor and an upper air distributor, said lower air distributor having a raised peripheral flange and grease trough extending around the periphery inwardly of said flange, said lower air distributor being formed with a corrugated central portion elevated above said trough so that grease deposited on said corrugated portion will drain into said trough, said corrugated portion having parallel channels separated by peaks having air discharge slots formed therein.

13. The forced air oven of claim 12 wherein said lower air distributor supports said stationary support means for supporting food to be cooked, said stationary support means including a plurality of parallel rods forming a horizontally extending support surface coextensive with said corrugated central portion of said lower air distributor, legs extending downwardly from the corners of said stationary support means for engagement with said trough to mount said stationary support means in spaced parallel relation to said corrugated central portion of said lower air distributor.

14. The forced air oven of claim 12 wherein said upper air distributor comprises a generally flat horizontally disposed plate having a peripherally disposed upstanding flange and an adjacent channel to strengthen said plate against deflection, parallel rows of slots formed in said plate in the area within said channel, each said slot having a nozzle portion extending below said plate to direct air flowing therethrough in a vertical direction, said plate having strengthening ribs extending transversely on said plate between said rows of slots.

15. A forced air oven which cooks by means of heated recirculated air comprising a box-like housing having vertical side walls, top and bottom walls, forming an oven enclosure and having a front opening closed by a door hingeably connected to said housing for movement between a position closing said opening and an open position permitting access to said enclosure, a pair of perforated plates forming upper and lower horizontal partitions in said enclosure dividing said enclosure into an upper plenum and a lower plenum separated by a cooking space, a blower supported on one of said side walls and air ducts for circulating air out of said cooking space into said blower and out of said blower into one of said plenums, a duct formed in one of said side walls to transfer air from said one plenum to the other of said plenums, said blower including a fan and motor drivingly connected to said fan, said motor and fan being mounted on the outside of said one side wall, said one side wall being formed with an air outlet opening located in said cooking space and adjacent to said fan to permit said fan to draw heated air out of said oven, said one side wall being formed with an air inlet opening in said lower plenum and adjacent to said fan to permit said fan to circulate air into said lower plenum, and a fan shroud enclosing said fan and said outlet and inlet openings, said fan shroud being detachably mounted on said one side wall so that it may be readily removed for cleaning.

16. The forced air oven of claim 15 wherein said fan shroud is a generally semicylindrical member having spaced parallel end walls and being open on one side which abuts the said one side wall of said oven with said outlet and inlet openings being within said member, said motor being mounted outside of said shroud and having a drive shaft which extends within said shroud and supports said fan.

17. An oven which cooks food by means of circulating heated air at high velocity into engagement with the food to be cooked comprising an oven enclosure having a front opening closed by a vertically disposed door which is hingeably connected to said enclosure to pivot between a closed position and an open position providing access to said enclosure, an electric air heater mounted in said enclosure, an upper perforated plate and a lower perforated plate being disposed horizontally and in vertically spaced relationship to divide said enclosure into an upper plenum space above said upper plate, a lower plenum space below said lower plate and a cooking space between said plates, said heater being mounted in said lower plenum space, and a removable duct which is mounted on a first wall of said enclosure to conduct heated air from said cooking space to said lower plenum space, a second duct in a second wall of said enclosure opposite to said first wall on which said removable duct is mounted.

18. The oven of claim 17 including a blower mounted on said enclosure, said blower comprising a fan driven by a motor, said fan being mounted within said removable duct and said motor being mounted outside of said duct, said first wall of said enclosure having a first opening through which heated air passes from said cooking space to said fan and a second opening through which air passes from said fan to said lower plenum space, said second duct having an entrance opening in said lower plenum space directly opposite said second opening to permit air to flow directly across said lower plenum space from said second opening to said entrance opening.

19. The oven of claim 18 wherein said second duct extends vertically upwardly from said entrance opening to an exit opening at the top of said enclosure within said upper plenum space, deflecting walls in said second duct to deflect upwardly air incoming at said entrance opening and to deflect horizontally air flowing upwardly in said second duct to exit opening.

20. The oven of claim 19 wherein said air heater extends horizontally within said lower plenum space, said air heater being spaced above the bottom of said enclosure and spaced below said lower perforated plate to permit air entering said lower plenum space through said second opening to pass above and below said air heater.

21. The oven of claim 18 wherein said second duct extends vertically upwardly from said entrance opening to an exit opening at the top of said enclosure within said upper plenum space, said oven enclosure being defined in part by a wall which also forms a wall of said second duct, and which divides said enclosure form said second duct, said second wall being detachably mounted in said oven to expose the interior of said second duct for cleaning purposes.

22. The oven of claim 21 wherein said upper perforated plate and said lower perforated plate are supported by projections on opposed walls of said oven enclosure and are readily removable through said front opening; said air heater being removably supported in said lower plenum space; removal of said perforated plates, said air heater, said wall of said second duct and said removable duct permitting unobstructed access to the interior of said oven for cleaning purposes.

23. A forced air portable electric oven for domestic use from a household power outlet and cooking by means of hot air heated electrically to a temperature of between 200 and 450 degrees F. comprising a light weight metal box-like housing having vertical side walls, top and bottom walls forming an oven enclosure having a front opening closed by a door hingeably connected to said housing for movement between a position closing said opening and an open position permitting access to said enclosure, a pair of horizontal light weight metal plates dividing said enclosure into an upper plenum and a lower plenum separated by a cooking space, a blower for continuously recirculating air from said cooking space into said lower plenum and said upper plenum at high velocity, said plates each being formed with a plurality of nozzles which discharge air into said cooking space at velocities in excess of 300 feet per minute toward food to be cooked therein, an air heater for heating said circulating air to a temperature of between 200 and 450 degrees F., said air heater including a sheathed electric heating element having radiator elements positioned in the path of said recirculating air, air heater control means responsive to the temperature of said recirculating air to control the supply of power to said heating element, said recirculating air limiting the surface temperature of said radiator elements to less than 800 degrees F., such air temperature and air heater temperature substantially eliminating the generation of smoke as a consequence of animal fats being entrailed with said recirculating air.

24. The forced air oven of claim 23 wherein said metal box-like housing is surrounded by a decorative plastic housing having walls spaced from the walls of said box-like housing, a layer of insulation between the walls of said housing having an R value of 4.3 hours.feet squared.degrees F./British Thermal Unit, said oven having a low thermal mass and sufficient insulating that with a power input to said air heater of approximately 1500 watts said recirculating air temperature is elevated to 350 degrees F. in less than 15 minutes.

25. The forced air oven of claim 23 wherein said air heater is disposed in said lower plenum, said sheathed heating element having a tortuous configuration and being disposed in a horizontal plane with a pair of closely spaced terminals, said radiator elements being formed on a die cast member which extends horizontally and completely encloses said heating element except for said terminals, said air heater being positioned below the lowermost of said metal plates and being substantially coextensive therewith.

26. The forced air oven of claim 25 wherein said air heater is provided with a drip shield extending horizontally between said lowermost metal plate and said die cast member, said die cast member being formed with upwardly extending projections which engage said shield and support it in spaced relation to said radiator elements.

27. The forced air oven of claim 26 wherein said blower is supported on one of said enclosure side walls and includes a motor driving a fan, said one side wall includes a first opening in said cooking space and adjacent said fan to permit said blower to withdraw air from said cooking space, said one side wall having a second opening in said lower plenum and adjacent said fan to permit said fan to discharge air into said lower plenum and across said air heater, a duct on the side of said enclosure opposite said one side wall for conducting heated air from said lower plenum to said upper plenum.

28. A forced air portable electric oven for domestic use from a household power outlet and cooking by means of hot air heated electrically to a temperature of between 300 and 450 degrees F. comprising a light weight metal box-like housing having vertical side walls, top and bottom walls forming an oven enclosure having a front opening closed by a door hingeably connected to said housing for movement between a position closing said opening and an open position permitting access to said enclosure, a pair of horizontal light weight metal plates dividing said enclosure into an upper plenum and a lower plenum separated by a cooking space, a blower for continuously recirculating air from said cooking space into said lower plenum and said upper plenum at high velocity, said plates each being formed with a plurality of nozzles which discharge air into said cooking space at velocities in excess of 300 feet per minute toward food to be cooked therein, an air heater for heating said circulating air to a temperature of between 300 and 450 degrees F., said air heater including a sheathed electric heating element having radiator elements positioned in the path of said recirculating air, air heater control means responsive to the temperature of said recirculating air to control the supply of power to said heating element, said recirculating air limiting the surface temperature of said radiator elements to less than 800 degrees F., such air temperature and air heater temperature substantially eliminating the generation of smoke as a consequence of animal fats being entrained with said recirculating air, said air heater being disposed in said lower plenum, said sheathed heating element having a tortuous configuration and being disposed in a horizontal plane with a pair of closely spaced terminals, said radiator elements being formed on a die cast member which extends horizontally and completely encloses said heating element except for said terminals, said air heater being positioned below the lowermost of said metal plates and being substantially coextensive therewith, said air heater being provided with a drip shield extending horizontally between said lowermost metal plate and said die cast member, said die cast member being formed with upwardly extending projections which engage said shield and support it in spaced relation to said radiator elements, said blower being supported on one of said enclosure side walls and including a motor driving a fan, said one side wall including a first opening in said cooking space and adjacent said fan to permit said blower to withdraw air from said cooking space, said one side wall having a second opening in said lower plenum and adjacent said fan to permit said fan to discharge air into said lower plenum and across said air heater, a duct on the side of said enclosure opposite said one side wall for conducting heated air from said lower plenum to said upper plenum, and a fan duct mounted on said one side wall and enclosing said fan and said first and second openings, said fan duct being a semicylindrical cup-shaped member with a side opening in the side that abuts said one side wall and a semicylindrical side wall that faces said side opening to form a shroud for said fan to direct air from said first opening through said fan and out said second opening.

29. In a forced air oven which cooks through the recirculation of heated air t high velocities, a food support comprising an apertured plate having a series of raised ribs separated by channel shaped depressions, said ribs being parallel and horizontally spaced, said ribs being formed with elongated nozzle openings which are spaced from each other and aligned centrally in each rib with the openings extending lengthwise of each rib, a food supporting rack substantially coextensive with said plate and including a plurality of parallel horizontally spaced bars to support food items to be cooked, means supporting said rack about said apertured plate with said bars extending transversely to said ribs, said nozzle openings in adjacent ribs being with each other in rows which in turn are aligned with said bars so that heated air discharged through said nozzle openings will impinge on said bars to heat said bars to the maximum extent possible.

30. The combination of claim 29 wherein said aperatured plate is formed with a continuous channel around the periphery of said plate adjacent to the portion of said plate including said ribs and depressions, said channel being spaced below the level of said depressions so that grease dripping into said depressions may run off into said channel, said food supporting rack being generally rectangular in shape having downwardly extending supporting legs in each corner, said legs being supported in said channel to mount said rack above said apertured plate with said bars aligned with said nozzle openings.

31. The combination of claim 29 wherein said nozzle openings are disposed at the uppermost portions of said ribs and each opening has formed walls extending vertically to direct a column of air toward the food to be cooked.

32. A forced air oven which cooks by means of circulating heated air at high velocity comprising an oven enclosure having means for recirculating heated air from a central food containing zone to upper end lower air distribution plenums, an upper perforated plate and a lower perforated plate which extend across said enclosure in spaced parallel relation to divide said enclosure into said food containing zone and said upper and lower air distribution plenums, said plates each being provided with a series of closely spaced nozzles distributed across the entire surface of each plate to direct air toward food in said food containing zone, a blower and an air heater for recirculating air heated to a temperature of between 350 and 450 degrees F. from said food containing zone to said upper and lower air distribution plenums from where the air passes through said nozzle into said food containing zone, a first air duct detachably mounted on the exterior of said enclosure to conduct air out of said food containing zone, through said blower and into one of said plenums, a second duct which conducts heated air from said one plenum to the other of said plenums, said second duct being formed with a removable wall to provide access to the interior of said second duct cleaning purposes.

33. The oven of claim 32 wherein said blower includes a centrifugal fan driven by a motor mounted on the outside of said enclosure, said first duct including walls for directing air from said food containing zone axially into said fan and for directing air discharged from said fan radially into said lower air distribution plenum, said second duct directing a portion of the air discharged into said lower plenum around said food containing zone into said upper plenum.

34. The oven of claim 33 wherein said motor includes a horizontally disposed armature shaft which supports said fan, a bearing wall mounted on the exterior of said enclosure and including a bearing which journals said armature shaft between said fan and said motor, said first duct being a cup shaped member having a mouth which faces a vertical side wall of said enclosure to form with said enclosure wall, a fan housing, openings formed in said side wall between said fan housing and said food containing zone and said housing and said lower plenum.

35. The oven of claim 34 wherein said cup-shaped member has a lip surrounding said mouth, said lip being sealed against said side wall by a gasket, manually operably retaining means on said side wall and cup-shaped member for detachably clamping said cup-shaped member in sealed engagement with said gasket.

36. The oven of claim 35 wherein said oven enclosure is formed of sheet metal in a box-like shape having top, and bottom walls, side walls, a rear wall and a front opening closed by a hingeably mounted door; a layer of heat insulating material positioned against the outer surface of said salls, a one-piece molded plastic housing having walls which are spaced from and parallel to said enclosure walls, said housing having a front opening which is closed by said door.

37. The oven of claim 36 wherein said plastic housing includes a second opening in one of its side walls and its rear wall providing access to said cup-shaped member which may be removed therethrough, an L-shaped removable cover for said second housing opening, said L-shaped cover being secured in sealed relationship to said second housing opening by manually actuably latch means.

38. A forced air portable oven which cooks by means of heated recirculated air comprising a housing having walls forming an oven enclosure and having an opening closed by a door connected to said housing for movement between a position closing said opening and an open position permitting access to said enclosure, a pair of perforated plates forming upper and lower horizontal partitions in said enclosure dividing said enclosure into an upper plenum and a lower plenum separated by a cooking space, means for supporting said perforated plates in a plurality of selectable vertically spaced positions to vary the height of said cooking space, said perforated plates being removable through said opening for cleaning purposes and to select one of said vertically spaced positions, stationary support means in said cooking space for supporting food to be cooked, a blower supported on said housing, heating means in said housing for heating the recirculating air, means mounted outside of said oven enclosure for circulating air out of said cooking space into said blower and out of said blower into one of said plenums, and means forming a duct in one of said walls to transfer air from said one plenum to the other of said plenums.

39. A force air portable oven which cooks by means of recirculated air comprising a housing having walls forming a oven enclosure and having an opening closed by a door connected to said housing for movement between a position closing said opening and an open position permitting access to said enclosure, a pair of perforated plates forming upper and lower horizontal partitions in said enclosure dividing said enclosure into an upper plenum and a lower plenum separated by a cooking space, stationary support means in said cooking space for supporting food to be cooked, a blower supported on said housing, heating means in said housing for heating the recirculating air, means mounted outside of said oven enclosure for circulating air out of said cooking space into said blower and out of said blower into one of said plenums, and means forming a duct in one of said walls to transfer air from said one plenum to the other of said plenums, said support means, said pair of perforated plates, said heating means and said means forming said duct being readily removable through said door for cleaning purposes and said means for circulating air out of the cooking space into said blower and out of said blower into one of said plenums being readily removable from said oven for cleaning purposes.

40. An oven which cooks food by means of circulating heated air at high velocity into engagement with the food to be cooked comprising an oven enclosure having a front opening closed by a vertically disposed door which is hingeably connected to said enclosure to pivot between a closed position and an open position providing access to said enclosure, an electric air heater mounted in said enclosure, an upper perforated plate and a lower perforated plate being disposed horizontally and in vertically spaced relationship to divide said enclosure into an upper plenum space above said upper plate, a lower plenum space below said lower plate and a cooking space between said plates, said heater being mounted in one of said plenum spaces, and a removable duct which is mounted on a first wall of said enclosure to conduct heated air from said cooking space to one of said plenum spaces, a second duct in a second wall of said enclosure opposite to said first wall on which said removable duct is mounted to conduct air from said one plenum space to the other plenum space.

41. The oven of claim 40 including a blower mounted on said enclosure, said blower comprising a fan driven by a motor, said fan being mounted within said removable duct and said motor being mounted outside of said duct, said first wall of said enclosure having a first opening through which heated air passes from said cooking space to said fan and a second opening through which air passes from said fan to said one of said plenum spaces, said second duct having an entrance opening in said one of said plenum spaces directly opposite said second opening to permit air to flow directly across said one of said plenum spaces from said second opening to said entrance opening.

* * * * *